US006097360A

United States Patent [19]

Holloman

[11] Patent Number: 6,097,360

[45] Date of Patent: Aug. 1, 2000

[54] ANALOG DRIVER FOR LED OR SIMILAR DISPLAY ELEMENT

[76] Inventor: Charles J Holloman, 272 Catamount Rd., Fairfield, Conn. 06430

[21] Appl. No.: 09/044,581

[22] Filed: Mar. 19, 1998

[51] Int. Cl.[7] ..... G09G 3/34; G09G 3/32; G09G 3/14

[52] U.S. Cl. ..... 345/84; 345/82; 345/83; 345/46

[58] Field of Search ..... 345/82–83, 84, 345/39, 46

[56] References Cited

U.S. PATENT DOCUMENTS

| | | | |
|---|---|---|---|
| 4,048,632 | 9/1977 | Spence | 340/336 |
| 4,298,869 | 11/1981 | Okuno | 340/782 |
| 5,708,452 | 1/1998 | Takahashi | 345/82 |
| 5,936,599 | 8/1999 | Reymond | 345/82 |

*Primary Examiner*—Richard A. Hjerpe
*Assistant Examiner*—Duc Q. Dinh
*Attorney, Agent, or Firm*—Pitney, Hardin, Kipp & Szuch LLP

[57] ABSTRACT

The analog driver for a display device which is controlled by current, such as an LED, includes a strobed analog input which charges a storage capacitor. The voltage across the storage capacitor is fed to the positive input of a comparator. The negative input of the comparator receives the voltage from a feedback resistor which is in series with the drive voltage, the drive FET (with a gate connected to the output of the comparator) and the light emitting device. Additionally, a reset FET is provided in parallel with the storage capacitor. Displays can be manufactured by a series of panels, each of the panels including an array of these drivers and light emitting devices, along with appropriate control circuitry.

18 Claims, 5 Drawing Sheets

BASIC ANALOG DRIVER

TYPICAL R/G/B PIXEL DRIVER ARRANGEMENT

SYSTEM LEVEL LOGIC

ANALOG DRIVER FOR LED OR SIMILAR DISPLAY ELEMENT

BACKGROUND OF THE INVENTION

1. Field of the Invention

This invention pertains to an analog memory driver for all classes of light emitting devices where the light output is a function of current. The analog memory driver is a memory unit and driver where the current through the display device is controlled by an analog voltage which is set from an analog drive line using a sample and hold circuit.

2. Description of the Prior Art

Well-designed current LED drivers currently usee a constant current drive to compensate for variations in the forward voltage drop of various LEDs, and where the current is set by operating voltages or with current regulators, and the intensity of the LED is controlled by pulse width modulation. The overall intensity of the display may be varied by either selecting alternate pulse width time periods, or by deleting small time segments of the LEDs that have been activated. The displays used for these video systems use eight bits to define the intensity for each of the red, blue and green LEDs which give 256 intensity levels for each of the three colors for a total of 16,777,216 color combinations. To accomplish this with a pulse width modulated system requires that the screen face be refreshed eight times with variable display intervals for each field within the frame time of standard video of 30 frames per second. While 30 frames per second is adequate for phosphor based video displays, it is not adequate for LED displays, and typically 120 frames per second must be used to remove the viewing artifacts when using instantaneous light emitting devices. This is a very difficult task for video based display systems of 320 by 256 pixels or larger and requires multiple processors to accomplish the task.

Prior art patents in this field include U.S. Pat. No. 4,659,967 issued on Apr. 21, 1987 to Dahl; U.S. Pat. No. 5,111,195 issued on May 5, 1992 to Fukuoka et al.; U.S. Pat. No. 5,250,939 issued on Oct. 5, 1993 to Takanashi; U.S. Pat. No. 5,325,106 issued on Jun. 28, 1994 to Bahraman; U.S. Pat. No. 5,363,118 issued on Nov. 8, 1994 to Okumura; U.S. Pat. No. 5,426,430 issued on Jun. 20, 1995 to Schlig; U.S. Patent No. 5,523,772 issued on Jun. 4, 1996 to Lee; U.S. Pat. No. 5,572,211 issued on Nov. 5, 1996 to Erhart et al.; U.S. Pat. No. 5,574,475 issued on Nov. 12, 1996 to Callahan, Jr. et al. and U.S. Pat. No. 5,633,651 issued on May 27, 1997 to Carvajal et al.

OBJECTS AND SUMMARY OF THE INVENTION

It is therefore an object of this invention to provide a driver for display devices wherein the light output is a function of current, such as LEDs, wherein the control signal is analog.

It is therefore a further object of this invention to provide a driver for display devices, such as LEDs, wherein the light output is a function of current which can be varied continuously whereby any number of intensity levels of light output are possible.

It is therefore a still further object of this invention to provide a driver for display devices wherein the light output is a function of current, such as LEDs, wherein the frame rate is as high as 120 frames per second.

It is therefore a still further object of this invention to provide a driver for display devices wherein the light output is a function of current, such as LEDs, wherein large displays can be controlled with a minimum number of processors.

These and other objects are attained by providing a display driver including a memory unit and driver where the current through the LED is controlled by an analog voltage which is set from an analog drive line using a sample and hold circuit. The analog signal enters a strobe FET (field effect transistor) which is activated by its gate during a specified strobe period, and the voltage is transferred to a storage capacitor and presented to the positive input of a comparator. The output of the comparator is connected to the gate of the drive FET which turns on passing current through the LED from its power source. The voltage developed on a feedback resistor is fedback to the negative input of the comparator and reduces its output drive until the voltage across the storage capacitor is equal to the voltage developed across the feedback resistor thereby stabilizing the drive current at the selected value. The reset FET is provided to remove the charge on the capacitor upon demand thereby blocking current from passing through the LED. The value of the storage capacitor is selected so that it will hold its charge within a specified tolerance until the next strobe cycle or reset pulse in view of the leakage current from the leakage resistance of the comparator and other associated devices.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
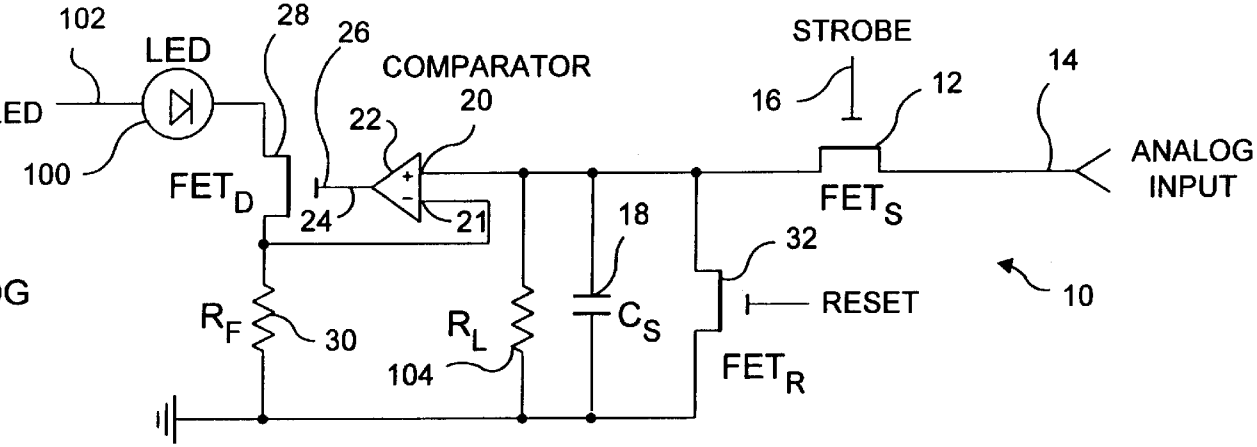
FIG. 1 is a schematic of the basic LED driver of the present invention.

Referring now to the drawings in detail wherein like numerals refer to like elements throughout the several views, one sees that FIG. 1 is a schematic of analog LED driver 10. Driver 10 is applicable not only to LEDs, but also to other display devices wherein the intensity is controlled by the current. The analog signal enters strobe FET (field effect transistor) 12 via line 14. Strobe FET 12 is activated by FET gate 16 during a specified strobe period and the voltage is transferred to storage capacitor 18 and presented to positive input 20 of comparator 22. Output 24 of comparator 22 is connected to gate 26 of drive FET 28 which turns on passing current through LED 100 from its power source 102. The voltage developed on feedback resistor 30 is fed back to the negative input 21 of comparator 22 and reduces both output 24 and the current through the LED 100 (and feedback resistor 30) until the voltage across storage capacitor 18 is equal to the voltage across feedback resistor 30 thereby resulting in a drive current through LED 100 and feedback resistor 30 which is stable at the selected value. Additionally, a reset FET 32 is provided in parallel with storage capacitor 18 to remove the charge upon the storage capacitor 18 thereby blocking all current from passing through LED 100. Additionally illustrated in FIG. 1 is leakage resistance 104 which represents the leakage resistance of the comparator 22 and all other devices attached to the positive input 20 of comparator 22. The value of storage capacitor 18 is chosen so that it will hold its charge within a specified tolerance until the next strobe or reset pulse in view of the leakage current through leakage resistance 104. If the input voltage is in the range of 0.0 to 1.0 volts and the desired current is 0 to 20 milliamps, feedback resistance would be selected to be 50 ohms, for example.

In the above configuration, the current in the LED 100 can be varied continuously from zero to 20 milliamps, and not just limited to 256 steps.

The overall brightness of a display including a plurality of LEDs 100 can be controlled by truncating the display interval using the RESET command which will not change the relationship between the various colors and intensity.

Leakage resistance 104 can be selected by adding a resistor (not shown) to have the resulting RC constant (with the storage capacitor 18) emulate the decay constant of video phosphors so that video image will appear as they do on a video screen. This cannot be done using conventional pulse width modulation.

Very long persistence displays can be made by using a one way pass transistor for the strobe FET 12 so that strobe FET will only add a voltage to the storage capacitor 18, not subtract from it. The reset pulse will reset the charge once per scan. This is useful for very slow scan displays as in radar systems.

Moving displays as for use as a stock ticker display requires precise control over the display periods to insure undistorted movements. It is possible to assign a portion of the display for moving tickers and control it display time using the reset pulse while the balance of the screen may have the variable persistence as required for a video display.

Figure 2:
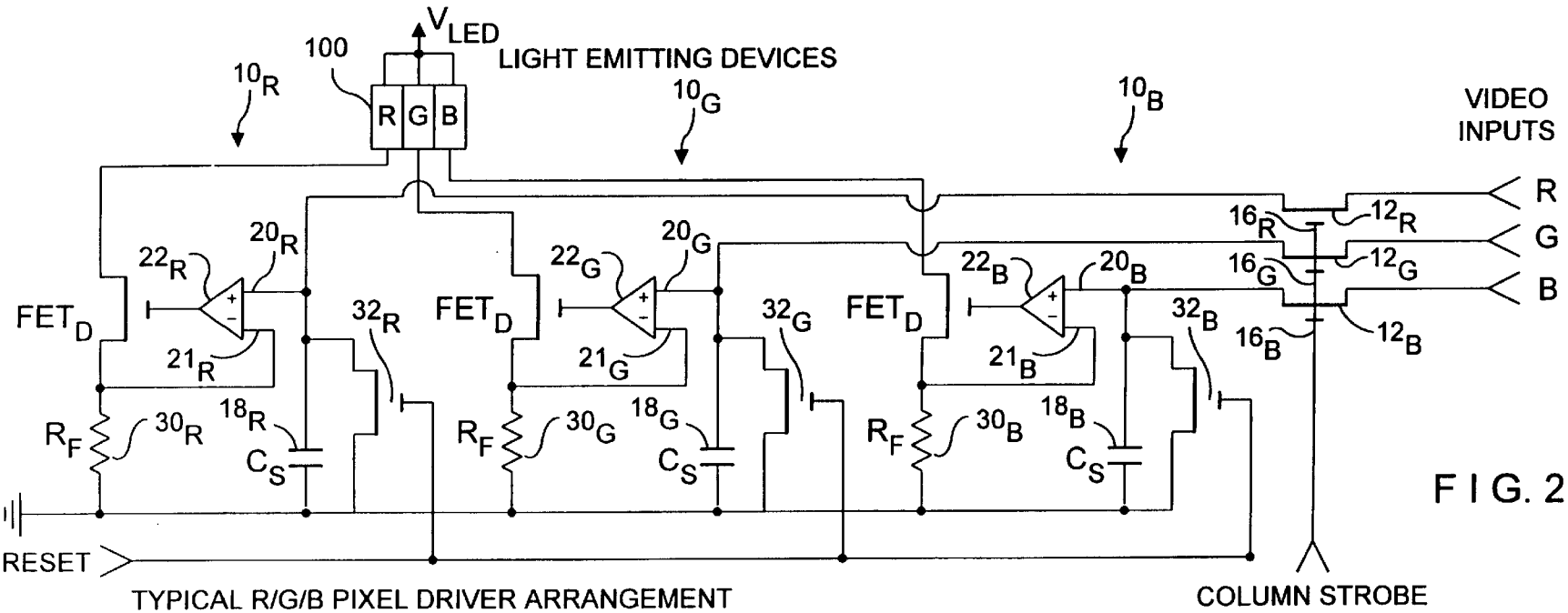
FIG. 2 is a schematic of the LED driver of the present invention as configured to drive a single pixel of a red/green/blue current-activated light emitting device.

FIG. 2 is a typical arrangement of three basic analog drivers $\mathbf{10}_R$, $\mathbf{10}_G$, $\mathbf{10}_B$ to drive a single pixel of red/green/blue current activated light emitting device 100. The three basic analog drivers $\mathbf{10}_R$, $\mathbf{10}_G$, $\mathbf{10}_B$ include elements corresponding to those shown in FIG. 1 but with the appropriate R, G or B (red, green or blue) subscripts.

Figure 3:
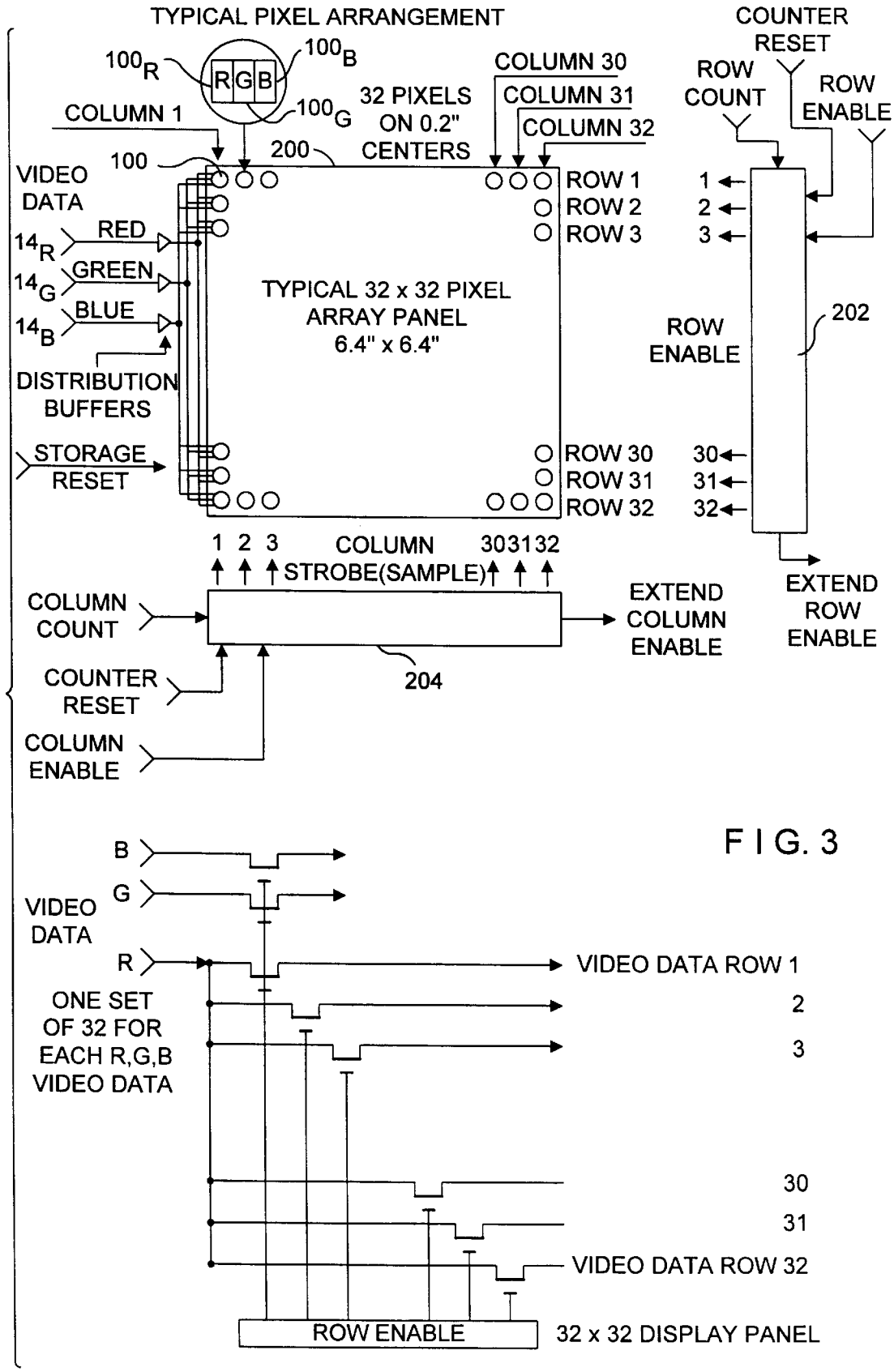
FIG. 3 is a schematic of a 32 by 32 pixel array of the LED drive of the present invention.

FIG. 3 is a schematic of a 32 by 32 array of pixels 100 are arranged on a basic panel 200 that will be used as a building block to make very large area displays. Panel 200 has the three light emitting devices $\mathbf{100}_R$, $\mathbf{100}_G$, $\mathbf{100}_B$ as color stripes arranged on 0.2 inch pixel spacing to make, for example a 6.4 inch by 6.4 inch basic panel 200. The pixels and pixel spacing can be any size, but the 0.2 inch pixel spacing shown is the most convenient for making wall sized displays for moderate sized rooms. The red, green and blue inputs $\mathbf{14}_R$, $\mathbf{14}_G$, $\mathbf{14}_B$ are presented to the entire array of 1024 pixels simultaneously. Alternately, in order to reduce radiated noise, the video signals can be gated with the row enable signal so that only one row will receive the analog signals at a time. Row enable selector 202 and column enable selector 204 are provided so that only one set of three analog drivers for one pixel are activated at one time. Each analog video line is provided with 32 switches, one for each row so that only one row of pixels are activated at any one time. The row enable selector 202 is a counter and a decoder which activates only one row at a time. The counter is activated when the row enable signal is active, and precesses on each row count. After all 32 rows have been activated in sequence, the outputs are turned off and the extend row enable out signal is activated to turn on the next panel of 32 rows. A row counter reset signal is required to reactivate the panel for reception of further data signals. The column strobe counter and decoder are activated one column at a time to strobe (or sample) and store the analog value of the red, green and blue video data into their respective analog drivers $\mathbf{10}_R$, $\mathbf{10}_G$, $\mathbf{10}_B$ one pixel at a time in a manner similar to the row enable system. When each of the 32 pixels in a row have been activated and the data stored, the extend column enable is made active to activate the next panel so that it may store subsequent data in the same row as the previous panel until the entire row of video data has been stored in their drivers at which time the row count is activated once and the column strobe counters have been reset with a column reset to prepare for the reception of the next row of video data. The storage reset line is made available to the entire panel but its use is not required for general operation, only for special control purposes as described hereinafter.

The analog drivers $\mathbf{10}_R$, $\mathbf{10}_G$, $\mathbf{10}_B$ the control counters and decoders 202, 204 and the video drivers are intended to be built on a common substrate using conventional TFT construction on glass, ceramic or a metal substrate as desired with the light emitting devices either deposited onto the analog drivers 10 using organic LED, polymer LED or other light emitting devices that can be deposited, or by using non-organic LEDs in chip form and installed on the analog drive pads and wire bonded to the LED supply voltage. The analog drivers may be made from conventional packaged components or made on conventional silicon substrates using conventional CMOS construction processes.

Figure 4:
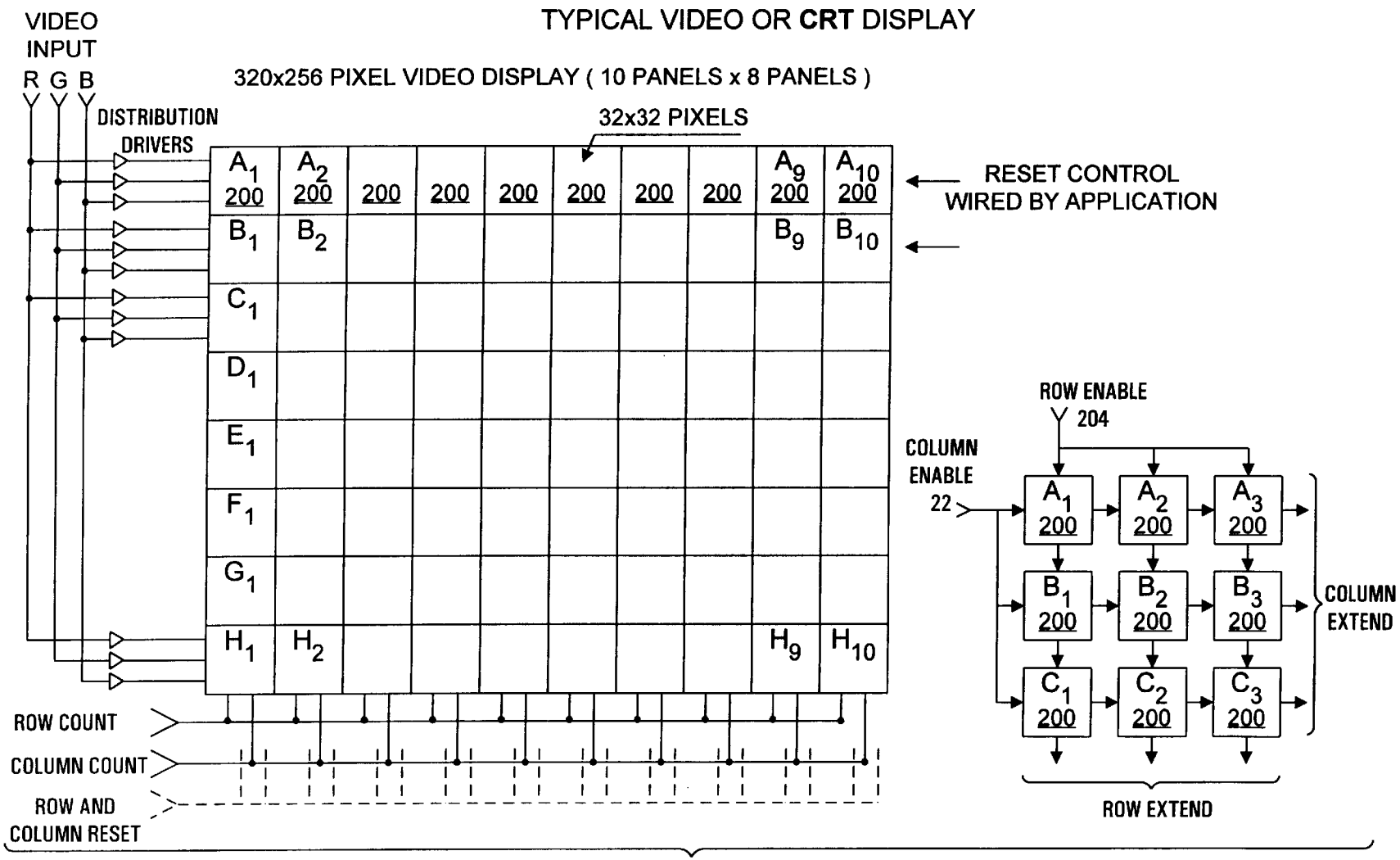
FIG. 4 is a schematic of an 8 by 10 array of the panels of FIG. 3.

FIG. 4 illustrates an array of 8 rows by 10 columns of the panels 200 of FIG. 3 thereby resulting in a display 300 with a 320 by 256 pixel array (each panel 200 being a 32 by 32 pixel array) thereby resulting in a display face suitable for emulating a CRT screen and displaying either an output from a computer terminal or standard NTSC video data. Any screen size can be assembled. The red, green and blue analog video data is presented to all panels simultaneously and selected for display as described in FIG. 3. Also shown in FIG. 4 is the interconnections of the row enable 204, column enable 202 and their extensions for panels 200 ($A_{1-3}$, $B_{1-3}$ and $C_{1-3}$). One row of panels, 32 pixel rows, may have its reset control wired to a control system to be shown in FIG. 5 which will allow it to have the precise 50/50 duty display cycle as required for smooth, artifact-free scrolling data movement.

Figure 5:
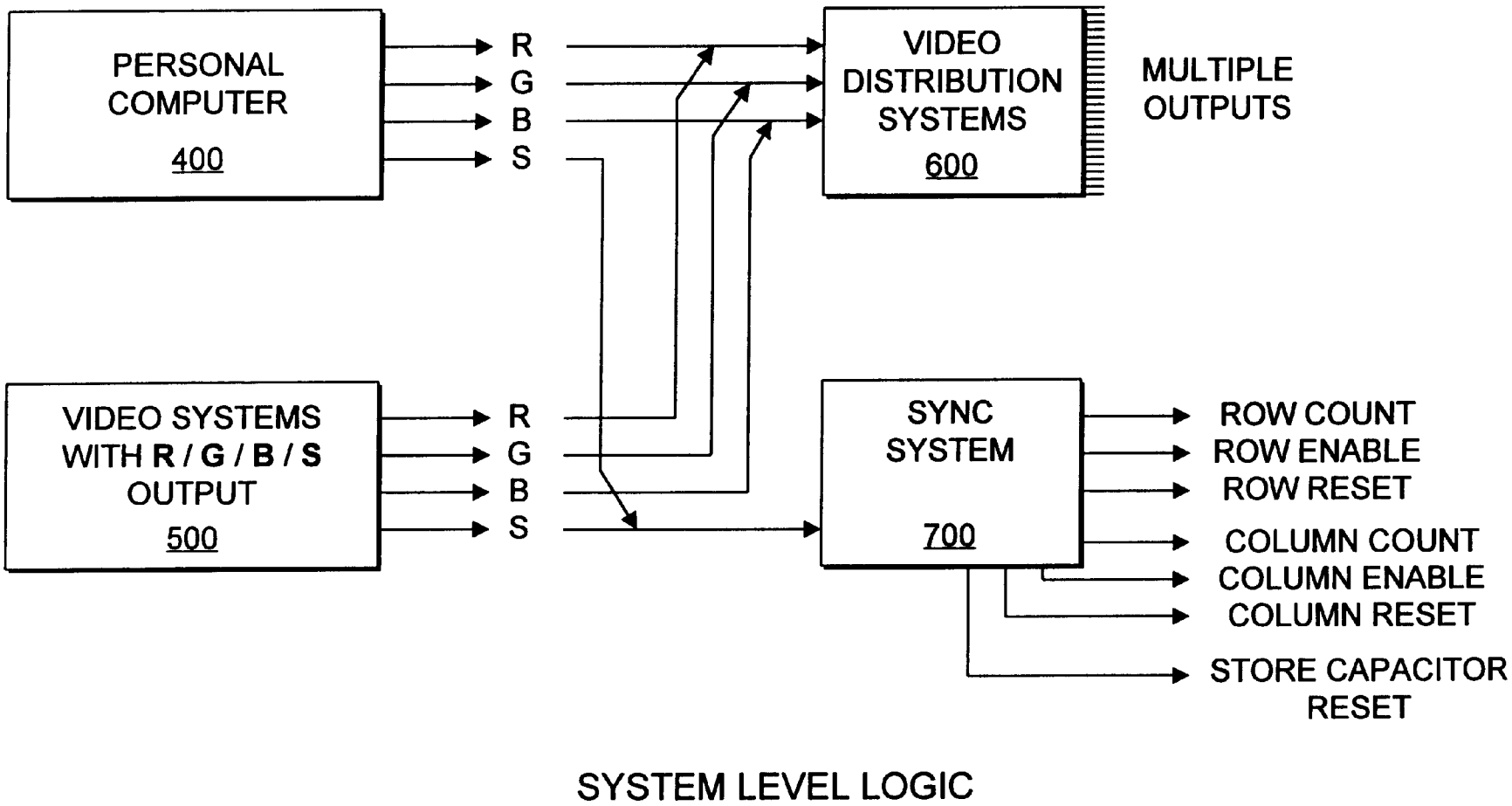
FIG. 5 is a block diagram illustrating how a red/green/blue signal and a sync computer output may be combined with or substituted for an appropriate video system.

FIG. 5 is a block diagram showing how either a red/green/blue and sync output from a computer 400 may be combined or substituted for a video system 500 that includes similar outputs. The video distribution system 600 includes simple low impedance buffers with unity gain to distribute the analog video signals to the panels 200 as required. The sync system 700 takes the combined horizontal and vertical sync signals and generates the column count, row count and reset signals required to coordinate the distribution of the video data. The Store Capacitor Reset signals are generated in this logic as required for the special display function as may be required.

Figure 6:
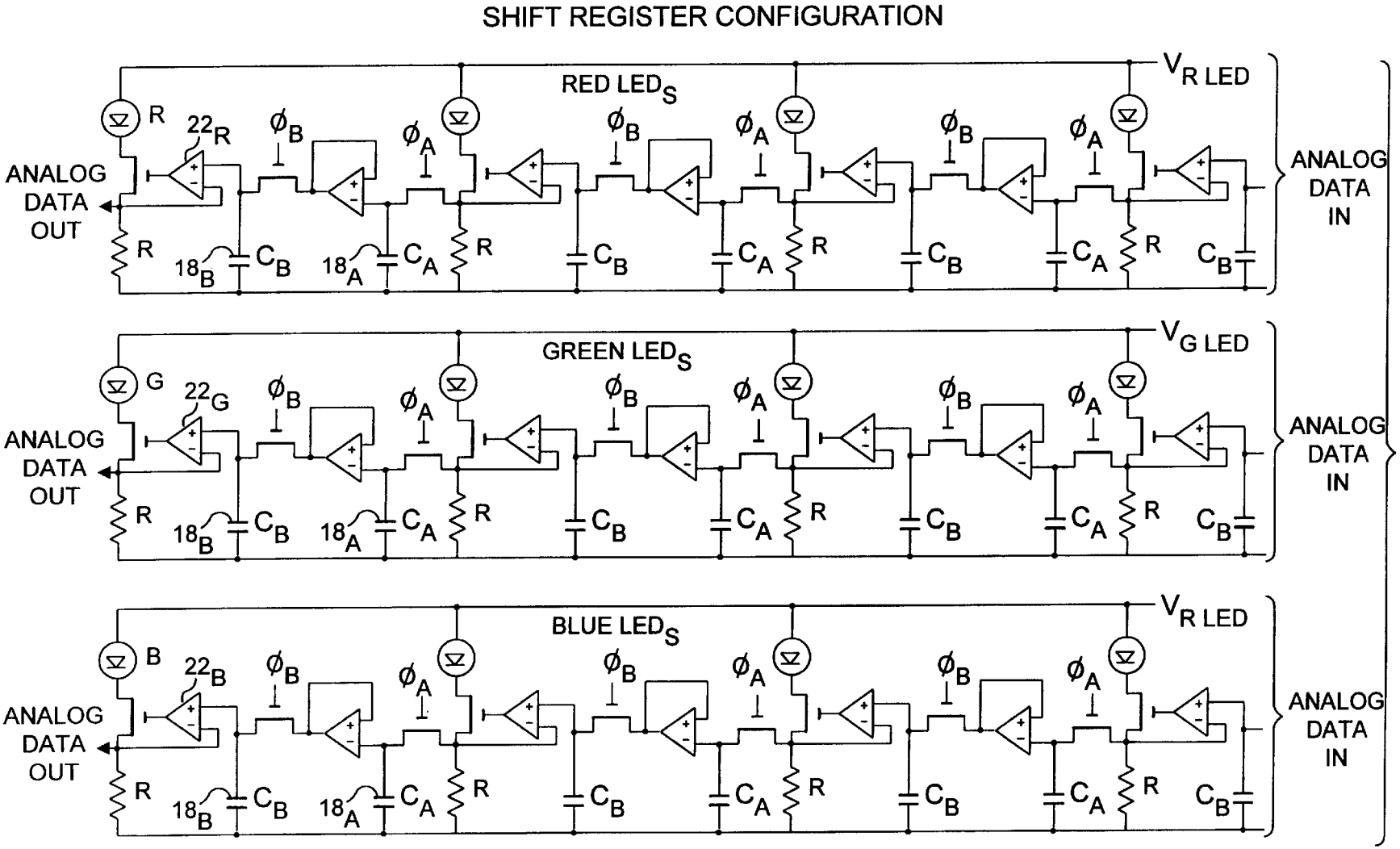
FIG. 6 is a block diagram of a shift register configuration of the present invention.

FIG. 6 is a analog shift register configuration of panel 200' wherein full color image can be moved down a display of essentially unlimited length in a manner similar to the monochrome, single intensity moving tickers as used for various stock and commodity exchanges. The driver 10 is substantially identical to that shown in FIG. 1 with clock $\Phi_B$ functioning as a strobe, and an interposing sample and hold stage has been provided using as second strobe identified as $\Phi_A$. When the data is to be moved to an adjacent display, $\Phi_A$ is strobed to transfer the charge stored in the prior analog drive 10 to a holding capacitor $C_A$ (or $\mathbf{18}_A$). Strobe $\Phi_A$ is deactivated and clock $\Phi_B$ activated to transfer the charge to capacitor $C_B$ (or $\mathbf{18}_B$). Thereby data is moved from one pixel to the next and full color images can be transferred through a practically unlimited number of stages. Interposing buffers (not shown) can be added from time to time with a gain greater than one to compensate for intervening losses, or one stage in each panel 200 can be modified to provide a minor signal gain to make the panel 200 have an overall gain of unity.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A device for controlling current through a light emitting device in accordance with an analog signal, comprising:

means for receiving the analog signal, means for charging a capacitor in accordance with the analog signal, and means for controlling current through the light emitting device in accordance with a voltage across said capacitor;

further including a first field effect transistor and a feedback resistor in series with said light emitting device and wherein said means for controlling current includes an operational amplifier with a positive input, a negative input and an output; wherein said positive input receives a voltage substantially equal to the voltage across said capacitor, said negative input receives a voltage substantially equal to the voltage across the feedback resistor and a gate of said first field effect transistor receives a voltage substantially equal to the voltage of said output of said operational amplifier.

2. The device of claim 1 further including a second field effect transistor for strobing said analog signal.

3. The device of claim 2 further including a third field effect transistor for discharging said capacitor.

4. The device of claim 3 further including a resistor to increase a leakage resistance of said operational amplifier, thereby adjusting an RC time constant and modifying a persistence of the device.

5. A device for controlling current through a three color light emitting device in accordance with three respective analog signals, wherein said three color light emitting device includes three respective color circuits, the device comprising for each respective analog signal:

means for receiving the respective analog signal, means for charging a capacitor in accordance with the respective analog signal, and means for controlling current through the respective color circuit of light emitting device in accordance with a voltage across said capacitor;

wherein the device for each respective analog signal further includes a first field effect transistor and a feedback resistor in series with said light emitting device and wherein said means for controlling current includes an operational amplifier with a positive input, a negative input and an output; wherein said positive input receives a voltage substantially equal to the voltage across said capacitor, said negative input receives a voltage substantially equal to the voltage across the feedback resistor and a gate of said first field effect transistor receives a voltage substantially equal to the voltage of said output of said operational amplifier.

6. The device of claim 5 wherein the device for each respective analog signal further includes a second field effect transistor for strobing said respective analog signal.

7. The device of claim 6 wherein the device for each respective analog signal further includes a third field effect transistor for discharging said capacitor.

8. The device of claim 7 wherein the device for each respective analog signal further includes a resistor to increase a leakage resistance of said operational amplifier, thereby adjusting an RC time constant and modifying a persistence of the device.

9. A panel including rows and columns of three color light emitting devices, each of said three color light emitting device responding in accordance with three respective analog signals, wherein each said three color light emitting device includes three respective color circuits, and comprising for each respective analog signal:

means for receiving the respective analog signal, means for charging a capacitor in accordance with the respective analog signal, and means for controlling current through the respective color circuit of light emitting device in accordance with a voltage across said capacitor;

wherein each light emitting device, further includes, for each respective analog signal, a first field effect transistor and a feedback resistor in series with said light emitting device and wherein said means for controlling current includes an operational amplifier with a positive input, a negative input and an output; wherein said positive input receives a voltage substantially equal to the voltage across said capacitor, said negative input receives a voltage substantially equal to the voltage across the feedback resistor and a gate of said first field effect transistor receives a voltage substantially equal to the voltage of said output of said operational amplifier.

10. The panel of claim 9 wherein each light emitting device, further includes, for each respective analog signal, a second field( effect transistor for strobing said respective analog signal.

11. The panel of claim 10 wherein each light emitting device further includes, for each respective analog signal, a third field effect transistor for discharging said capacitor.

12. The panel of claim 11 wherein said rows are sequentially provided with input data.

13. The panel of claim 12 wherein each light emitting device further includes, for each respective analog signal, a resistor to increase a leakage resistance of each said respective operational amplifier, thereby adjusting an RC time constant and modifying a persistence of the respective device.

14. A display comprised of a plurality of the panels of claim 9.

15. A display comprised of a plurality of the panels of claim 10.

16. A display comprised of a plurality of the panels of claim 11.

17. A display comprised of a plurality of the panels of claim 12.

18. A display comprised of a plurality of the panels of claim 13.

* * * * *